US007004438B2

(12) United States Patent
Lin

(10) Patent No.: US 7,004,438 B2
(45) Date of Patent: Feb. 28, 2006

(54) ANGULARLY ADJUSTABLE KEYBOARD SUPPORT BRACKET

(75) Inventor: Sheng-Hsiung Lin, Taipei (TW)

(73) Assignee: Puu Rong Industries Co., Ltd., Taipei (TW)

( * ) Notice: Subject to any disclaimer, the term of this patent is extended or adjusted under 35 U.S.C. 154(b) by 0 days.

(21) Appl. No.: 10/821,926

(22) Filed: Apr. 12, 2004

(65) Prior Publication Data

US 2005/0224671 A1 Oct. 13, 2005

(51) Int. Cl.
*A47F 5/00* (2006.01)

(52) U.S. Cl. ..... 248/289.11; 248/918

(58) Field of Classification Search ..... 248/918, 248/284.1, 278.1, 279.1, 280.11, 281.11, 248/118, 118.1, 118.3, 118.5
See application file for complete search history.

(56) References Cited

U.S. PATENT DOCUMENTS 4,546,708 A * 10/1985 Wilburth ..... 108/94
4,616,798 A 10/1986 Smeenge et al. ..... 248/281.11
4,687,167 A * 8/1987 Skalka et al. ..... 248/126
5,123,621 A * 6/1992 Gates ..... 248/281.11
5,257,676 A 11/1993 Merkley et al. ..... 181/5
5,924,664 A 7/1999 Mileos et al. ..... 248/281.11
6,086,034 A * 7/2000 McAllister et al. ..... 248/278.1
6,186,460 B1 * 2/2001 Lin ..... 248/284.1
6,478,279 B1 * 11/2002 Barber ..... 248/424

* cited by examiner

*Primary Examiner*—Robert P. Olszewski
*Assistant Examiner*—A. Joseph Wujciak
(74) *Attorney, Agent, or Firm*—Birch, Stewart, Kolasch & Birch, LLP

(57) ABSTRACT

An angularly adjustable keyboard support bracket includes a mounting rack attached to a desktop, a movable arm coupled with the mounting rack through a pin, and a bracing rack coupled with another end of the movable arm through another pin for holding a tray. A rotary mechanism is located between the bracing rack and the tray to enable the tray to swivel to the left side and the right side for a selected angle relative to the bracing rack to provide users with a desired operating angle.

11 Claims, 7 Drawing Sheets

ANGULARLY ADJUSTABLE KEYBOARD SUPPORT BRACKET

FIELD OF THE INVENTION

The present invention relates to an angularly adjustable keyboard support bracket, and more particularly to a bracket that has a tray to hold a keyboard and can swivel angularly to the left and right side relative to the bracket to facilitate user operation.

BACKGROUND OF THE INVENTION

Home computers have spread like wildfire since the last decade. In order to facilitate user operation of the keyboard, save desktop space, and take into account ergonomics to prevent wrist, neck and back injuries resulting from maintaining the same posture over a prolonged period, brackets have been developed and used to support the keyboard and make step-less adjustment to suit user's posture and hand positions.

Reference of keyboard bracket can be found in U.S. Pat. Nos. 4,616,798, 5,257,767, 5,924,664, and U.S. patent application Ser. No. 10/609,558 submitted by Applicant. All those patents still have drawbacks in terms of user operation angle, notably:

The screen generally is mounted on a near left side or right side of the desktop rather than in front of the user. When the user is operating the keyboard bracket, he/she has to look at the screen in a biased manner. It tends to strain and fatigue the eyes and affect user's vision. Although the cited patent references mentioned above have a rotary tray between the bracket and the desktop, the perimeter area of the swivel angle is based on the radius of the entire keyboard bracket, namely the swivel area takes a relatively large space. The space under the desktop and beside the bracket needs to be free to move. This is a big problem for people working in the office who often have limited space. Moreover, most users have cabinets located under the desktop, and the space behind the chair is always limited. It is difficult to allocate adequate space for the swivel of the keyboard bracket. Hence, most keyboard brackets are used to adjust the elevation. The swivel function to turn the screen angularly to the left and right side is not frequently used. Thus, the benefit of the keyboard bracket is not fully enjoyed.

SUMMARY OF THE INVENTION

Therefore, the primary object of this invention is to solve the aforesaid disadvantages. The invention provides an angularly adjustable keyboard support bracket that can be adjusted according to the viewing angle of the screen without fully pulling out the keyboard bracket and without the concern of limited space behind the user's chair. The invention mainly has a rotary mechanism located between the bracket and a tray that can swivel left and right for a selected angle to offer users a desired operating angle.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 1:
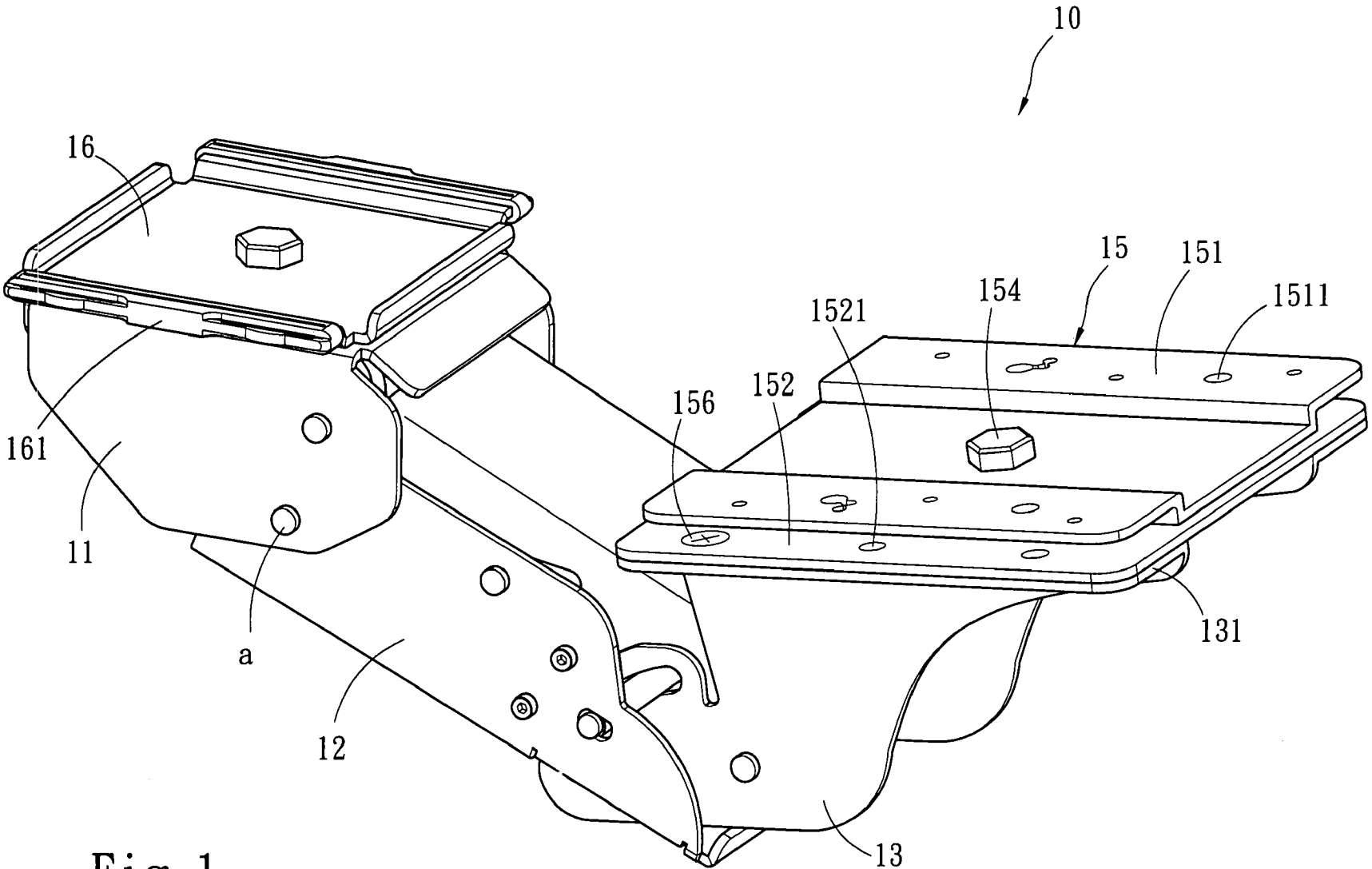
FIG. 1 is a perspective view of the present invention.
Figure 2:
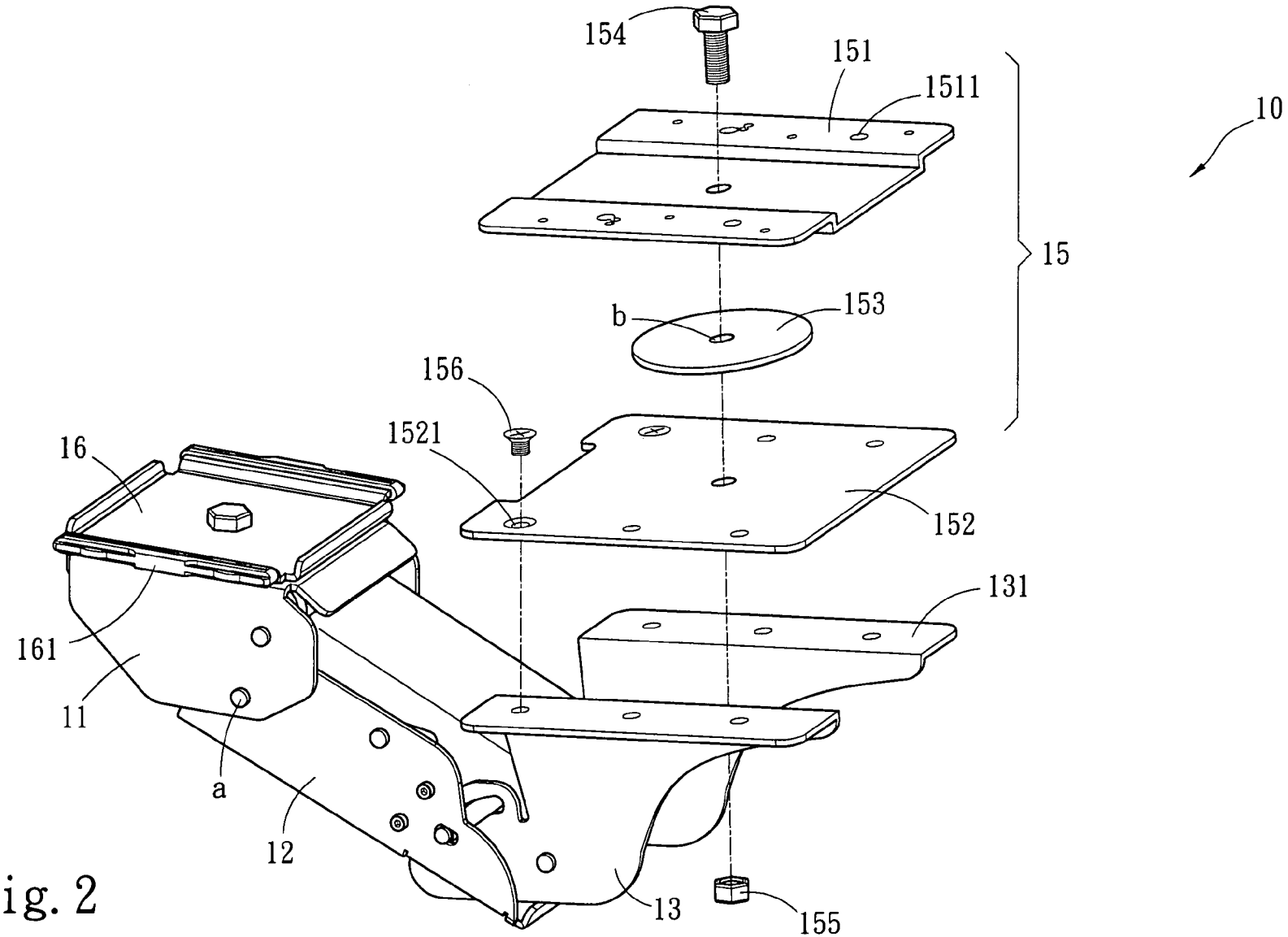
FIG. 2 is an exploded view of the present invention.

Referring to FIGS, 1, 2, 5A and 5B, the angularly adjustable keyboard support bracket according to the invention includes a bracket 10 which has a mounting rack 11 fastened to a desktop 20 (FIG. 3B), a movable arm 12 coupled with the mounting rack 11 through a pin a, and a bracing rack 13 coupling with the movable arm 12 on another end through another pin a for holding a tray 14. The bracing rack 13 is extended to form a holding section 131. There is a rotary mechanism 15 located between the holding section 131 and the tray 14. The rotary mechanism 15 enables the tray 14 to swivel to the left side and the right side for a selected angle relative to the bracing rack 13 to provide users with a desired operation angle. The rotary mechanism 15 includes a rotary tray 152 fastened to the bracing rack 13, an anchor tray 151 coupled with the tray 14 and a retaining element 153 located between the anchor tray 151 and the rotary tray 152. The rotary tray 152 has an anchor hole 1521 to receive a fastening member 156 to run through the holding section 131 of the bracing rack 13 for fastening the rotary tray 152 to the holding section 131. The anchor tray 151 has an anchor hole 1511 to receive a fastening member to run through the tray 14 for fastening the tray 14 to the anchor tray 151. The anchor tray 151, rotary tray 152 and retaining element 153 have respectively an axle hole b to couple with a bolt 154 to engage with a nut 155 for fastening.

Figure 3A:
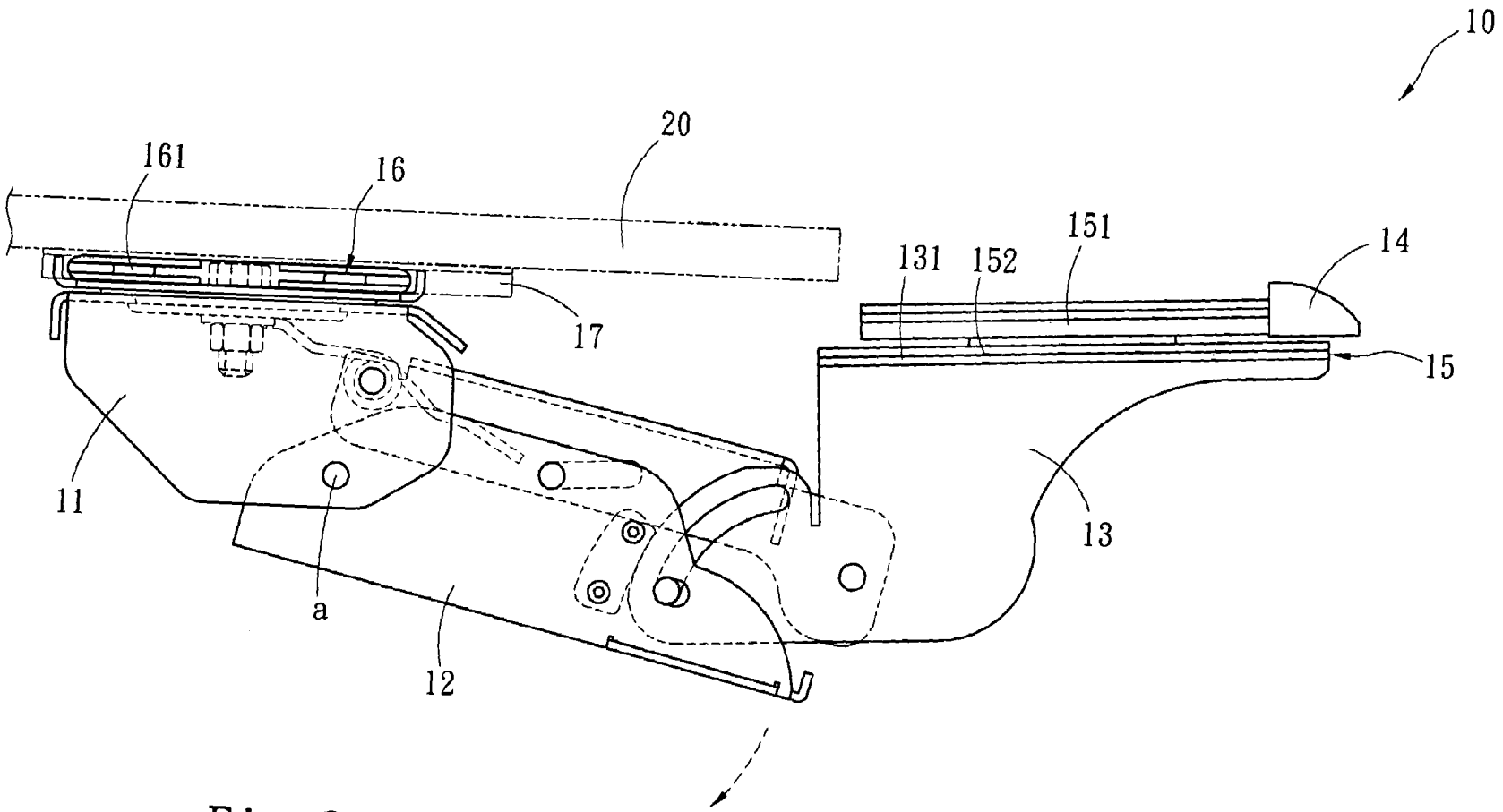
FIGS. 3A and 3B are schematic views of the present invention moving upwards and downwards relative to a desktop.
Figure 3B:
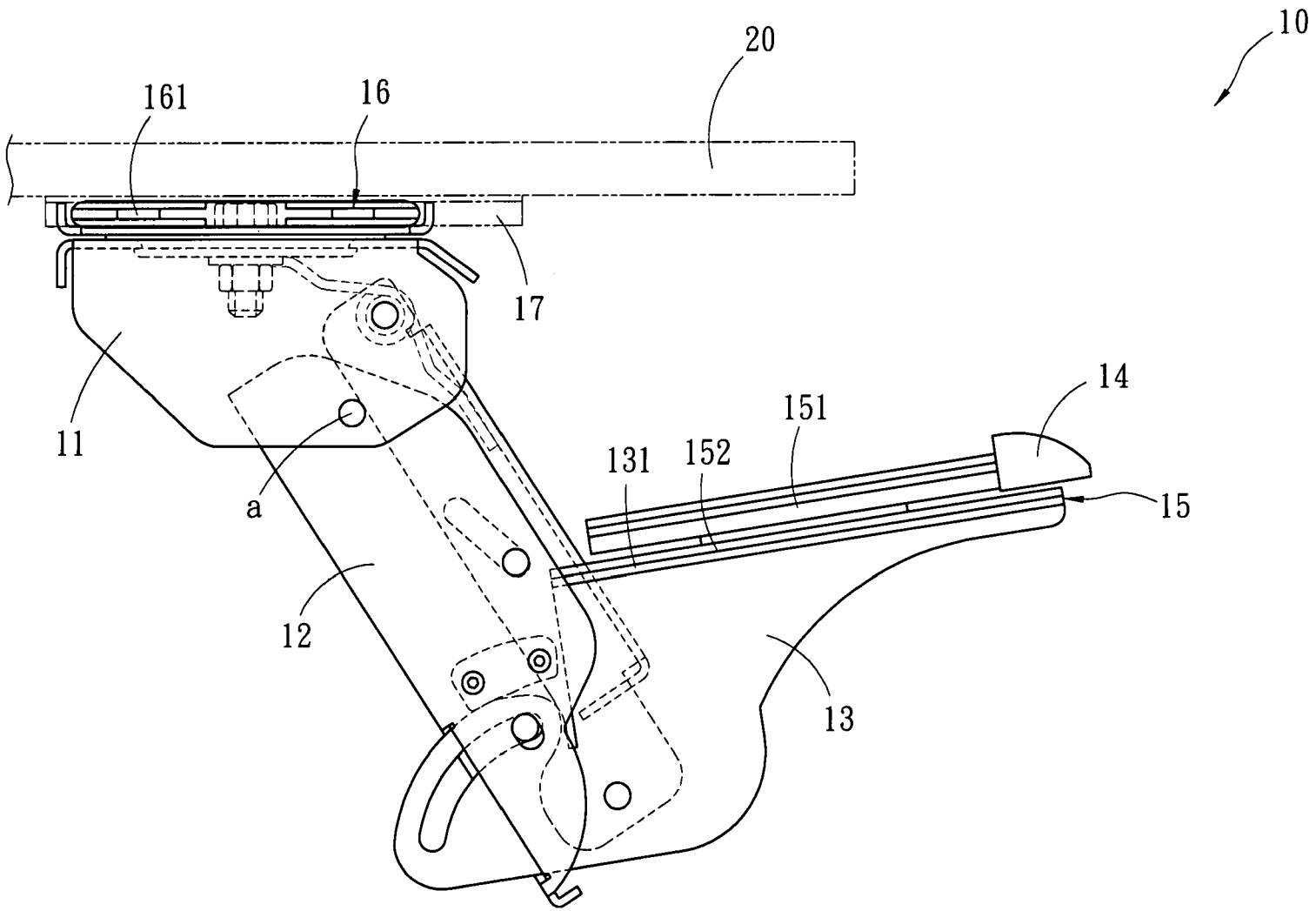
Figure 4:
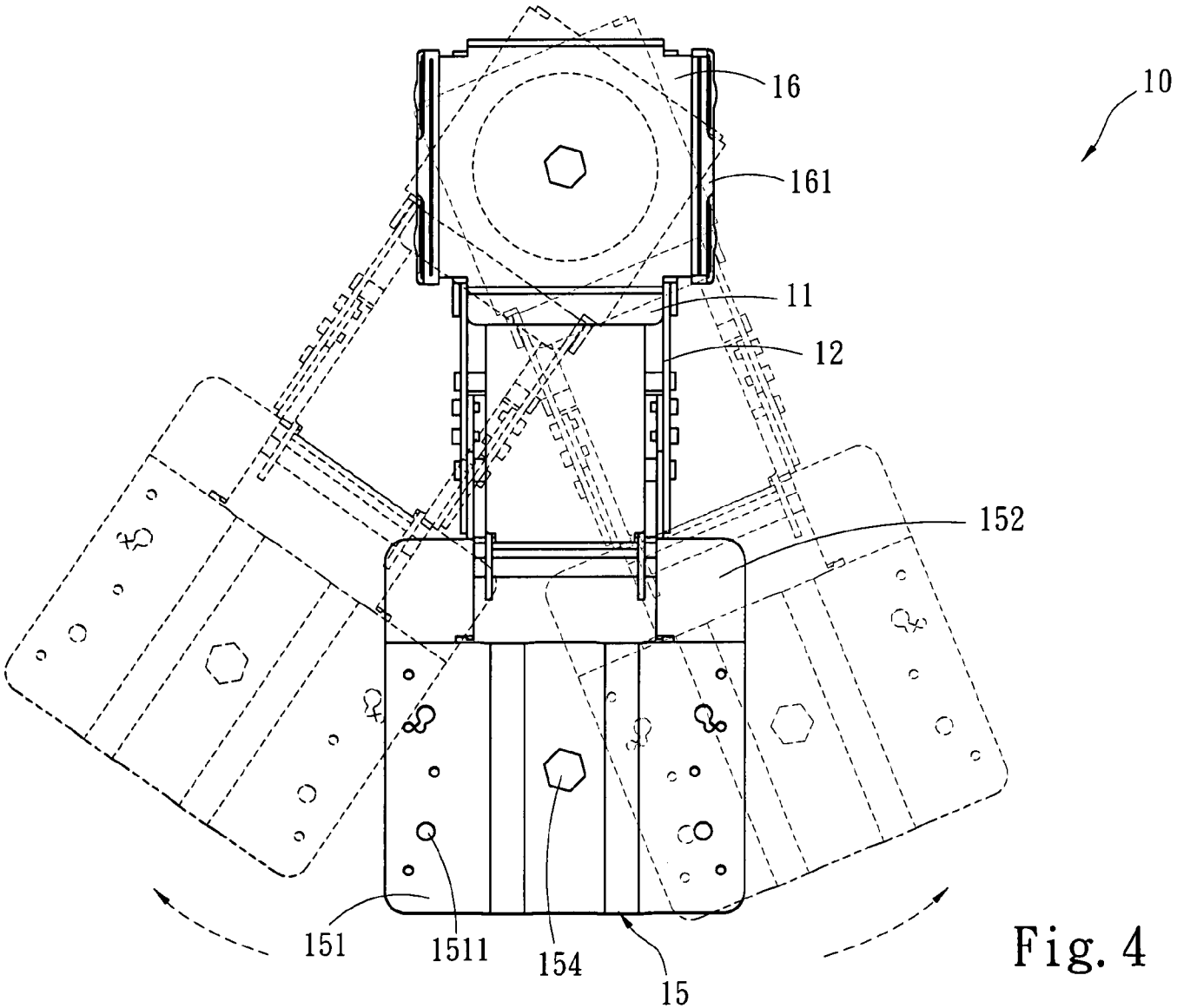
FIG. 4 is a schematic view of the invention swiveling to the left and the right side relative to the desktop.

Refer to FIGS. 3A and 3B for the movable arm 12 moving upwards and downwards relative to the desktop 20 according to the invention. As shown in the drawings, a rotary tray mechanism 16 is located between the mounting rack 11 and the desktop 20. Two sliding track blades 161 located on two sides of the rotary tray mechanism 16 couple with the sliding tracks 17 under the desktop 20. Through the sliding tracks 17, the bracket 10 may be pulled out at a distance according to the space available behind the user and the viewing distance. The elevation of operation may be adjusted to suit user's sitting posture as shown in FIG. 3B. Since the mechanism for adjusting the elevation is not covered by the present application and has been disclosed in the prior art, e.g., U.S. Pat. No. 4,616,798 cited above, the detailed operation of the mechanism for adjusting the elevation will not be discussed here.

Figure 5A:
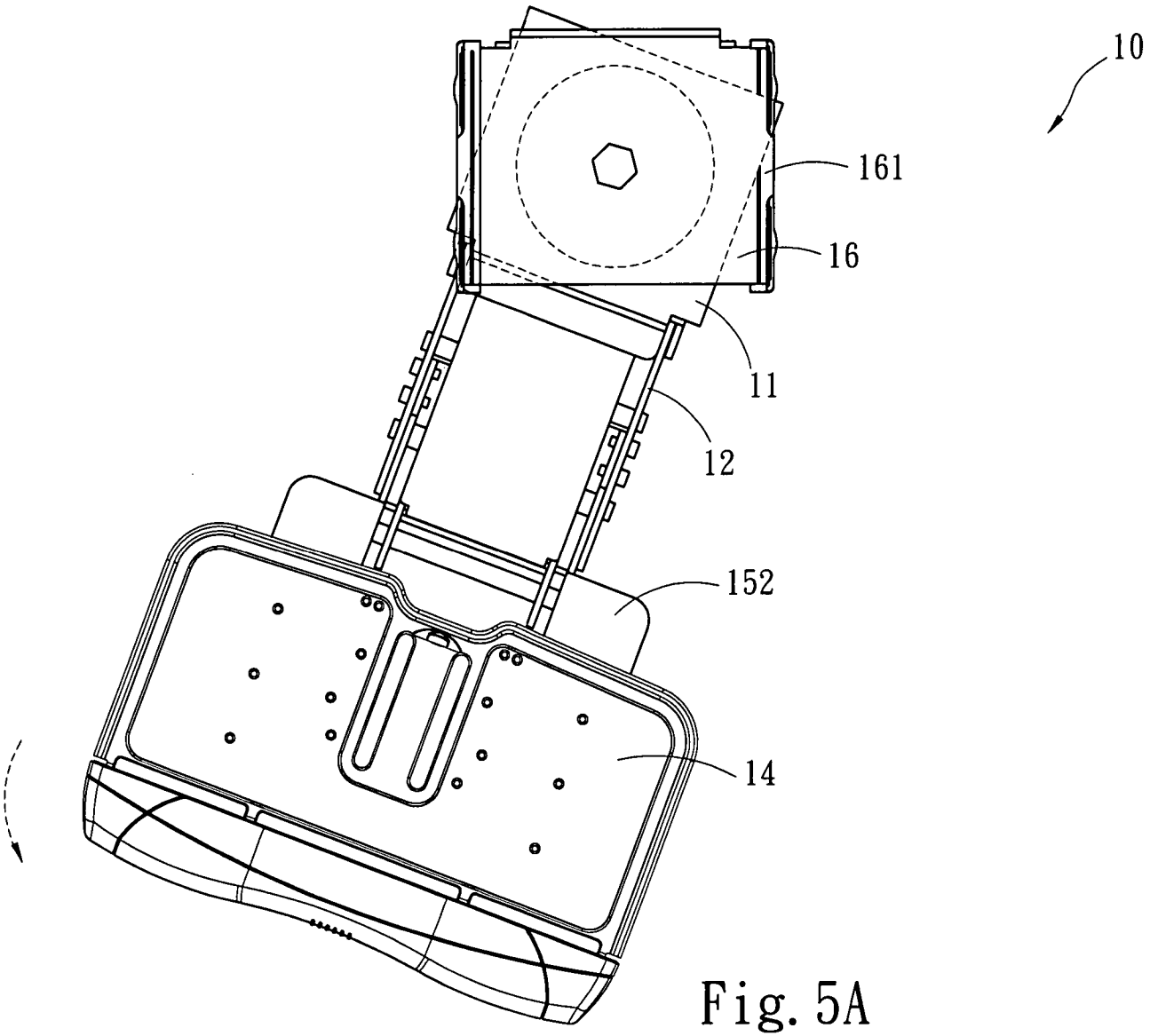
FIGS. 5A and 5B are schematic views of the invention with the tray swiveling to left side and right side relative to the bracing rack.
Figure 5B:
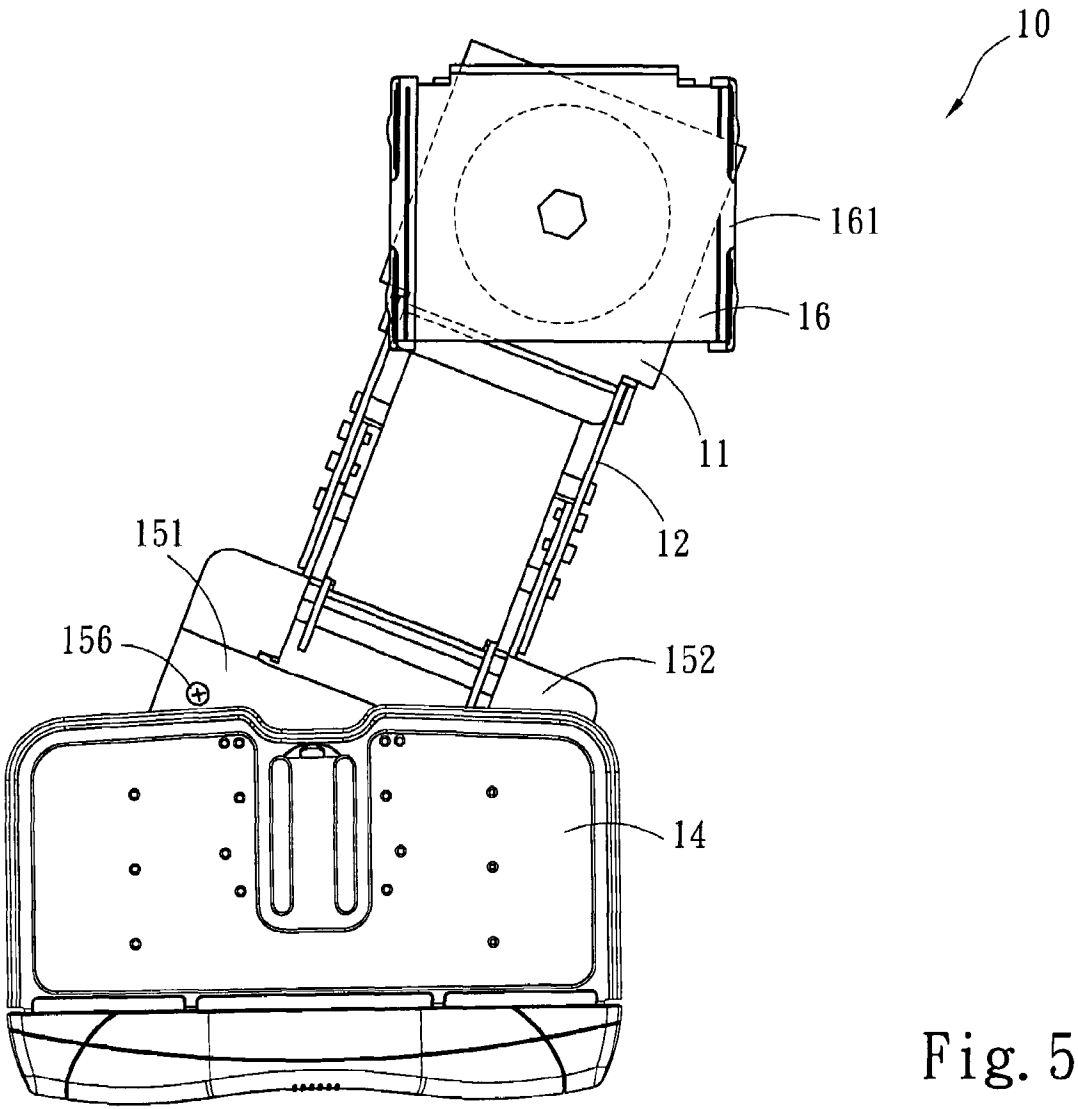

In the event that the space behind the user is not adequate or the space under the desktop 20 is limited and cannot accommodate the movable arm 12, referring to FIG. 5A, first, the rotary mechanism 16 coupled on the rear end of the mounting rack 11 may be used to swivel to the left side or right side for a selected angle within the allowable adjusting space. Alternatively, as shown in FIGS. 5A and 5B, when the user wants to change the keyboard operation position corresponding to the screen, he/she may directly exert a force on the tray 14 to turn the tray about the bolt 154 relative to the bracing rack 13 to the left side or the right side for a desired angle. The retaining element 153 provides a frictional force that allows the tray 14 to remain stationary after the desired angle has been reached. Thereby the user can alter the keyboard-operating angle within the limited space without viewing the screen in a biased manner. Therefore, fatigue and impact to user's vision can be reduced. Moreover, the rotary mechanism 15 of the invention may be directly adapted to the bracket 10 of the previous patents mentioned before to further increase the applicability.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments that do not depart from the spirit and scope of the invention.

What is claimed is:

1. An angularly adjustable keyboard support bracket comprising:

a mounting rack attached to a desktop;

a movable arm coupled with the mounting rack through a first pin; and a bracing rack coupled on another end of the movable arm through a second pin, the bracing rack including a holding section at a top of the bracing rack;

a tray; and a rotary mechanism, the rotary mechanism being attached to and held by the holding section, the rotary mechanism being located between the holding section and the tray, the rotary mechanism including an anchor tray, a rotary tray, and a retaining element located between the anchor tray and the rotary tray, the tray being fastened to the anchor tray, the rotary tray being directly fastened to and non-movable relative to the holding section, each of the anchor tray, the rotary tray and the retaining element having an hole aligned along an axis, a bolt being inserted into the hole of the anchor tray, the rotary tray and the retaining element and being engaged with a nut, the rotary mechanism allowing the tray to swivel to a left side and a right side, the tray being rotatable relative to both the holding section of the bracing rack and the rotary tray to provide a user with a desired operating angle.

2. The angularly adjustable keyboard support bracket of claim 1, wherein the rotary tray has a first anchor hole that receives a fastening member to run through the holding section of the bracing rack for fastening the rotary tray to the holding section of the bracing rack, and the anchor tray has a second anchor hole for receiving a second fastening member to run through the tray for fastening the tray to the anchor tray.

3. The angularly adjustable keyboard support bracket of claim 1, wherein during the swiveling of the tray relative to the holding section, the rotary tray is fixed and non-movable relative to the holding section.

4. The angularly adjustable keyboard support bracket of claim 1, wherein the holding section of the bracing section rack is horizontally non-pivotable to the movable arm.

5. The angularly adjustable keyboard support bracket of claim 1, wherein the nut engaged with the bolt is located at a bottom of the rotary tray.

6. The angularly adjustable keyboard support bracket of claim 1, wherein the holding section includes two arms separately separated from each other.

7. The angularly adjustable keyboard support bracket of claim 1, wherein the tray is a keyboard tray.

8. The angularly adjustable keyboard support bracket of claim 3, wherein the holding section of the bracing rack is horizontally non-pivotable to the movable arm.

9. The angularly adjustable keyboard support bracket of claim 8, wherein the nut engaged with the bolt is located at a bottom of the rotary tray.

10. The angularly adjustable keyboard support bracket of claim 9, wherein the holding section includes two arms separated from each other.

11. The angularly adjustable keyboard support bracket of claim 10, wherein the tray is a keyboard tray.

* * * * *